United States Patent [19]

Schmidgall et al.

[11] Patent Number: 4,999,965

[45] Date of Patent: Mar. 19, 1991

[54] SPACER FOR DOUBLE CAGE REINFORCEMENT WIRE MESH FOR CONCRETE PRODUCTS

[75] Inventors: Jon A. Schmidgall, Mediapolis; Galen G. Metzger, Oakville, both of Iowa

[73] Assignee: Hawkeye Concrete Products Co., Mediapolis, Iowa

[21] Appl. No.: 511,394

[22] Filed: Apr. 18, 1990

[51] Int. Cl.[5] ..... E04C 5/16

[52] U.S. Cl. ..... 52/684; 52/677; 52/652; 52/719

[58] Field of Search ..... 52/650, 652, 677, 680, 52/682, 687, 712, 714, 684, 719

[56] References Cited

U.S. PATENT DOCUMENTS

| | | | |
|---|---|---|---|
| 1,543,207 | 6/1925 | Erb et al. | 52/719 |
| 1,750,100 | 3/1930 | Heltzel | 52/677 |
| 3,440,792 | 4/1969 | Schmidgall | 52/650 X |
| 3,722,164 | 3/1973 | Schmidgall | 52/652 X |
| 4,301,638 | 11/1981 | Schmidgall | 52/677 X |
| 4,835,934 | 6/1989 | Swenson | 52/687 |

FOREIGN PATENT DOCUMENTS

| | | | |
|---|---|---|---|
| 520481 | 1/1931 | Fed. Rep. of Germany | 52/652 |

*Primary Examiner*—David A. Scherbel
*Assistant Examiner*—Creighton Smith
*Attorney, Agent, or Firm*—James C. Nemmers

[57] ABSTRACT

A spacer for use in locking two cages into an integral unit of reinforcement and spacing the reinforcement from the surface of the form used in making large concrete products such as box sections, pipes, culverts and manholes. The spacer provides for precise placement of the reinforcement cages without the necessity of welding or the use of ties to retain the spacer in place. The spacer uses an eye configuration for spacing a torsion lock that provides for both ease of installation and positive locking of the spacer onto the cages.

3 Claims, 1 Drawing Sheet

FIG. 1
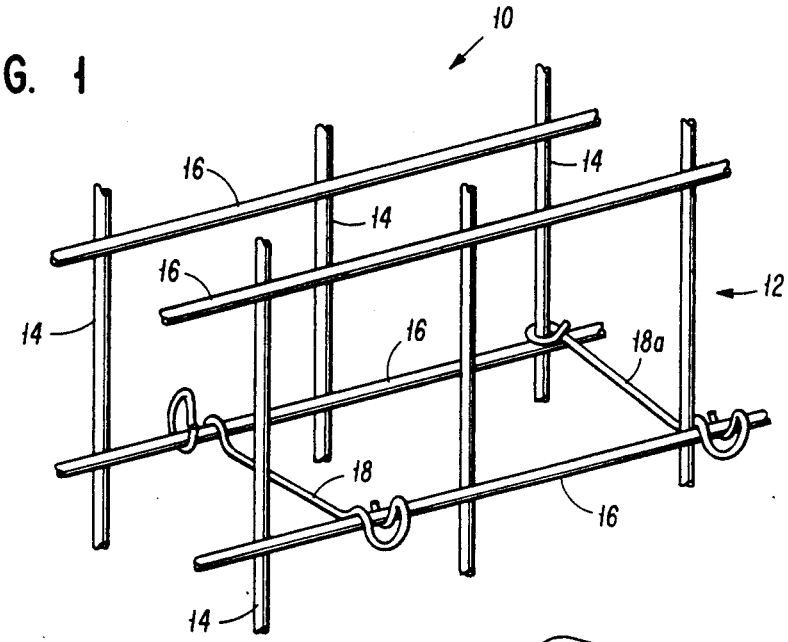
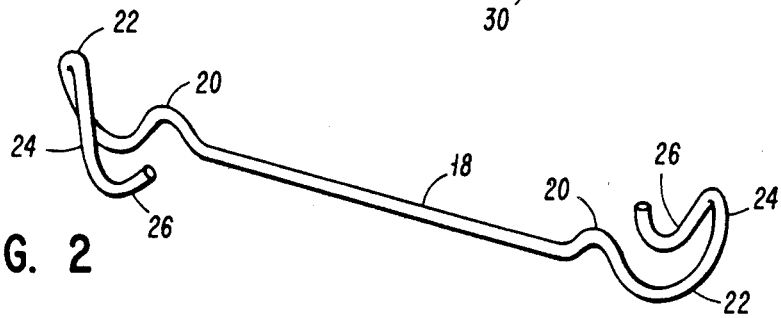
FIG. 2
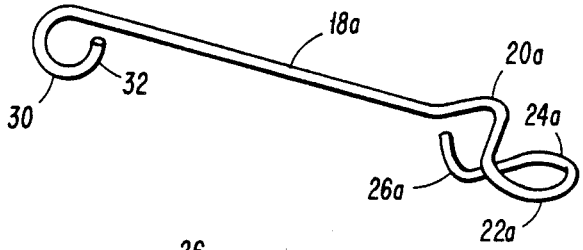
FIG. 3
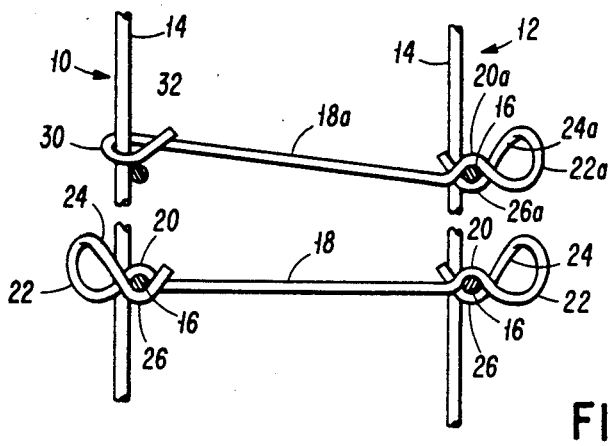
FIG. 4

SPACER FOR DOUBLE CAGE REINFORCEMENT WIRE MESH FOR CONCRETE PRODUCTS

BACKGROUND OF THE INVENTION

In producing large concrete products such as box sections, round pipes, culverts or manholes, two reinforcement wire mesh cages are required to provide the necessary strength. The cages must be spaced from each other and also spaced from the surfaces of the form used to produce the particular concrete product.

At the present time, the most common spacer used for double cage reinforcement wire mesh for rectangular concrete products, such as box sections, is a spacer that has an eye at each end of a straight section. The eyes serve to space each of the cages from the surfaces of the product form. The straight piece between the eyes determines the spacing between the two reinforcement cages. However, in order to retain these commonly-used spacers in place, the spacers are welded to the mesh at the junction of the eye and straight piece. In some instances, specifications prohibit welding of the spacers to the reinforcement mesh because the welds tend to weaken the tensile strength of the circumferential wire of the mesh. In order to comply with such specifications, the spacers therefore are tied to the mesh by hand using a small soft tie wire. This obviously requires additional labor, thus adding to the cost of the product, and equally important, the soft wires used to tie the spacer to the mesh have little strength and sometimes will break during the production of the concrete products.

There is another form of spacer that is suitable for use on the double cage reinforcement mesh for the large round concrete products. The common spacer used for this purpose is disclosed in U.S. Pat. No. 3,440,792. This spacer has an eye on one end and a J-hook on the other end, the latter being hooked to one cage while the eye is hooked over the circumferential wire of the other cage. The eye serves to space the cage from the form. However, if the wire mesh cages are not precisely made as is often the case, it is possible for the spacer to fall off when the concrete is poured into the forms. This occurs when the spacers are installed loosely on the cages because the cages are too close together and therefore do not exert sufficient force on the spacers to maintain them in place.

Especially with the box section products which use rectangular double cage reinforcement mesh, none of the prior art spacers will hold against forces tending to separate the two cages or tending to move them closer together unless the spacers are welded or tied to the cages. There are also twisting forces which are exerted on the cages while the concrete is being poured into the forms and around the cages, which forces tend to loosen the prior art spacers unless welded or tied onto the cages as is always done for the rectangular cages used in box sections. With the circular cages, welding or tying the spacers to the cages is not generally done, but because of the various forces exerted on the cages during the pipe manufacturing process, loosening of the spacers may still occur.

There is therefore a need for an improved spacer which can be used with the reinforcement cages for rectangular products, such as box sections, which spacers will resist forces exerted on the cages in any direction without becoming loose and falling off the cages during the process of producing the concrete products.

There is a further need for a spacer that can be easily installed from outside of the double cage and which does not require welding or other special attachment to the cages, thus speeding up the installation process and making it less costly to the producer of the concrete products.

SUMMARY OF THE INVENTION

In one embodiment of the invention, the double cage spacer is constructed of spring steel and has a center straight section that joins U-shaped portions which determine the distance between the cages. Extending outwardly from the U-shaped portions are loops at the outer end of which are hooks that lock the spacer onto the circumferential wires of the cages. The loops extend outwardly from each of the cages to provide the spacing of the cages from the concrete forms. In another embodiment of the invention for spacers useable primarily in the double cages for round pipes and the like, one end of the spacer has a hook and loop similar to the other embodiment which hook will lock the spacer onto one of the cages while the loop spaces the cages from the concrete form. However, unlike the first embodiment, the other end of the spacer has a simple hook only which hook can be attached either to a horizontal or vertical wire of the inside cage. In either embodiment, both ends of the spacer torsionally lock onto the cages, one end producing torque in one direction and the other producing torque on the cages in the opposite direction thereby producing forces that cancel out each other around the cages. Also, the torsional lock produced at each end of each spacer provides a positive lock that eliminates the necessity of welding or otherwise securing the spacers to the cages.

BRIEF DESCRIPTION OF THE DRAWINGS

FIG. 1 is a perspective view showing a portion of two wire mesh cages with the spacers of the two embodiments of the invention locked in place;

FIG. 2 is a perspective view of a first embodiment of a spacer constructed according to the principles of the invention;

FIG. 3 is a perspective view of a second embodiment of a spacer constructed according to the principles of the invention; and FIG. 4 is a side elevational view of the spacers of FIGS. 2 and 3 in place on the double cage and illustrating the positive, torsional locking of the spacer.

DESCRIPTION OF THE PREFERRED EMBODIMENTS OF THE INVENTION

Referring first to FIG. 1, there is illustrated two reinforcement wire mesh cages that are required for the larger round and rectangular pipes, culverts and manhole concrete products. The inner cage 10 and the outer cage 12 each have a plurality of parallel spaced apart vertical wires 14 joined to a plurality of horizontally spaced apart parallel circumferential wires 16. As is well known to those skilled in the art, these cages 10 and 12 are positioned inside of the annular space defined by the forms used in producing a particular rectangular or cylindrical concrete product that will ultimately used as a box section, a pipe, culvert, or manhole. The cages 10 and 12 therefore must be properly positioned inside of the annular space between the forms, which space will be filled with concrete surrounding the reinforcement cages and it is important that the cages 10 and 12 be properly spaced from each other and also properly spaced from the surfaces of the form. It is also important that the cages maintain the proper position throughout the process of produing the concrete product. Since these processes employ vibration and other forces to assure that all of the voids in the form are filled with concrete, twisting and other forces are exerted upon the cages 10 and 12 during the process of manufacture. The spacers constructed according to the principles of the invention are capable of resisting all of the forces, twisting and otherwise, and once in place, the spacers of the invention will not fall off even though not welded or otherwise tied to the cages.

In FIG. 2, and also shown in FIGS. 1 and 4, there is illustrated a spacer 18 designed primarily for use in connection with the rectangular cages used for box sections. These rectangular cages must be spaced from the surfaces of both the inner and outer concrete forms because the cages have no inherent resistance to forces tending to move them either inwardly or outwardly. To accomplish all of the necessary functions of spacing and positively locking the two cages 10 and 12, the spacer of this first embodiment of the invention has a central straight portion 18 with a U-shaped spacing loop 20 formed at opposite ends of the straight portion 18. These spacing loops 20 positively position both of the cages at the predetermined distance between the two loops 20.

In order to space the cages 10 and 12 from both the inner and outer surfaces of the concrete forms, an eye 22 is formed at the outer ends of the spacer, each eye 22 being in the form of an open loop, the outer leg 24 of which is directed away from the plane of the central straight portion 18. The outer leg 24 at each end of the spacer terminates in a hook 26. The functions of the various configurations of the spacer are best understood by an explanation of how the spacer is installed on the cages 10 and 12.

The installer is normally outside of the outer cage 12, and to install a spacer on the cages 10 and 12, the installer grasps one end of the spacer and inserts it inwardly between two of the circumferential wires 16 on each of the cages 10 and 12. It makes no difference which end of the spacer is grasped, since the spacer is symmetrical and each end is identical. Once the spacer is inserted between two of the circumferential wires 16, it is rotated about ninety degrees until the hook 26 is beneath a circumferential wire 16 of the inner cage 10. The spacer is then pulled outwardly until the spacing loop 20 at the inner end is just above the wire 16. The spacer is then rotated clockwise approximately ninety degrees until the hook 26 at the inner end of the spacer is engaged beneath the wire 16 and the spacing loop 20 rests on top of that same wire 16. At this time, the spacing loop 20 at the outer end will also be resting on top of the corresponding circumferential wire 16 of the outer cage 12. Because the spacer is made of a spring steel, the spacer is then rotated further in a clockwise direction until the hook 26 at the outer end of the spacer snaps beneath the circumferential wire 16 on the outer cage 12. This will require a simple tool in order to obtain the proper leverage and force to flex the spacer sufficiently so that the hook 26 at the outer end of the spacer can snap beneath the circumferential wire 16 on the outer cage 12. Once this is done, the spacer is locked in place, and because the spring steel will return to its original shape, each end of the spacer will be firmly locked onto a circumferential wire 16 of the inner cage 10 and the outer cage 12. The positive torsional locking and grasping of a wire 16 between the spacing loop 20 and the hook 26 at each end of the spacer is illustrated in FIG. 4. The installation therefore is quickly and easily done with a simple tool.

When properly installed as described above, the configuration of the spacer tightly locks the inner cage 10 and outer cage 12 into an integral unit of reinforcement. The eyes 22 space both cages, and with the spacers of the invention properly in place, the double cage rectangular reinforcement cannot move in either direction toward either surface of the form, and the double cage reinforcement will therefore stay properly positioned throughout the manufacturing process. Because of the positive torsional locking feature provided by the unique configuration at each end of the spacer of the invention, the spacers will not fall off during the manufacturing process, and the spacer will resist forces in any direction without becoming loose. Also, there is no concern as to which way the spacer is to be installed, since it is symmetrical and identical at each end, and provides spacing from both surfaces of the form.

The second embodiment of the invention is illustrated in FIG. 3 and is also shown in FIGS. 1 and 4. The spacer of this second embodiment is designed for use with circular cages used in producing cylindrical-shaped products such as pipes and maholes. Unlike the rectangular cages for the box sections, the circular cages need to be spaced only from the surface of the outer concrete form as long as the cages are positively spaced from each other. Therefore, the spacer of the second embodiment is similar to that of the embodiment of FIG. 2 in that it has a central straight portion **18*a* with a U-shaped spacing loop 20*a* formed at one end of the straight portion 18*a*. Together with the hook 26*a* at the other end of the spacer, the spacing loop 20*a* positively positions both of the cages 10 and 12** at the desired predetermined distance.

In order to space the cages 10 and 12 (these being circular cages in the second embodiment) from both the inner and outer surfaces of the concrete forms, it is only necessary to form an eye **22*a* at the outer end of the spacer, the eye 22*a* being in the form of an open loop, the outer leg 24*a* of which is directed away from the plane of the central straight portion 18*a*. The outer leg 24*a* at the end of the spacer terminates in hook 26*a*. At the other end of the spacer opposite the eye 22*a*, the spacer has only a hook 30 which is formed with a terminal end 32 extending across and through the plane of the straight portion 18*a* and the loop 22*a*. The functions of the various configurations of the spacer are best understood by an explanation of how the spacer is installed on the cages 10 and 12**, which installation is similar to that of installing the spacer of the first embodiment.

The installer is normaly outside of the outer cage 12, and to install the spacer of the second embodiment on circular cages !0 and 12, the installer grasps the eye **22*a* of the spacer and inserts the end of the spacer containing the hook 30 inwardly between two of the circumferential wires 16 on each of the cages 10 and 12. The hook 30 can be hooked to either a circumferential wire 16 or a vertical wire !4. In FIGS. 1 and 4, the spacer is shown as being hooked onto a vertical wire 14. It makes no difference which wire is engaged by hook 30, since the spacer will function equally as well in either instance. Once the spacer is inserted between two of the circumferential wires 16, it is rotated until the hook 30 is fully engaged around a wire 14 or 16 of the inner cage 10**.

The spacer is then rotated until the loop 20*a* is just above a wire 16 of the outer cage 10 and is further rotated, using a lever tool, until the hook 26*a* at the outer end of the spacer is engaged beneath the wire 16 and the spacing loop 20 rests on top of that same wire 16 of the outer cage. Because the spacer is made of a spring steel, the simple lever tool will provide the proper leverage and force to flex the spacer sufficiently so that the hook 26*a* at the outer end of the spacer can snap beneath the circumferential wire 16 on the outer cage 12. Once this is done, the spacer is locked in place, and because the spring steel will return to its original shape, each end of the spacer will be firmly locked onto a circumferential wire 16 or vertical wire 14 of the inner cage 10 and a circumferential wire 16 the outer cage 12. The positive torsional locking and grasping of a wire 16 between the spacing loop 20*a* and the hook 26*a* at the outer end of the spacer and the hooking of the vertical wire 14 at the inner end is illustrated in FIG. 4. As with the spacer of the first embodiment, the installation therefore is quickly and easily done with a simple tool.

When properly installed as described above, the configuration of the spacer of this second embodiment tightly locks the circular inner cage 10 and outer cage 12 into an integral unit of reinforcement. The eye 22*a* spaces both cages since the inherent forces of a circular body will not permit the cages to move inwardly, being resisted by the eyes 22*a* at the diametrically opposite side of the cages. Thus, with the spacers of the second embodiment of the invention properly in place, the double cage circular reinforcement cannot move in either direction toward either surface of the concrete form, and the double cage reinforcement will therefore stay properly positioned throughout the manufacturing process. As in the first embodiment, because of the positive torsional locking feature provided by the unique configuration at each end of the spacer of the second embodiment, the spacers will not fall off during the manufacturing process, and the spacer will resist forces in any direction without becoming loose.

The benefits of the improved spacers of the invention are therefore simplified double cage fabrication with reduced labor costs and higher quality cages since neither welding nor ties are required. The spacers of both embodiments of the invention are formed from a continuous piece of spring steel wire, and are therefore easy and relatively inexpensive to manufacture.

Having thus described the invention in connection with preferred embodiments thereof, it will be evident to those skilled in the art that various revisions and modifications can be made to the preferred embodiments disclosed herein without departing from the spirit and scope of the invention. It is our intention, however, that all such revisions and modifications as are obvious to those skilled in the art will be included without the scope of the following claims.

What is claimed is as follows:

1. A spacer for positioning the inner and outer wire mesh concrete reinforcing cages used in forms for producing concrete structures such as box sections and pipes, which cages each have a plurality of parallel spaced-apart horizontal wires joined to a plurality of paralled spaced-apart vertical wires and which cages are positioned in a form that has spaced-apart inner and outer surfaces, said spacer also serving to maintain the cages a predetermined distance away from the surfaces of the form, said spacer comprising a continuous length of spring-steel material of a substantially round cross-section, a central substantially straight portion having a U-shaped loop formed in the material near a first end of the spacer, the loop being formed to extend over one of the wires of the outer cage to position that cage, an eye extending outwardly from the loop to form a rounded nose that it is engageable with the outer surface of the concrete form to position the outer cage a predetermined distance away from the outer surface, and a locking leg of the spacer extending downwardly and inwardly from the nose to form a locking hook at the first end of the spacer in a plane spaced from the plane of the loop, said hook extending under, inwardly and then upwardly around the same one of the wires of the outer cage engageable by the loop, and locking means at the second end of the straight portion of the spacer to positively lock the second end onto a wire of the inner cage so as to position the inner cage relative to the outer cage, the locking hook being such that when the locking means is engaged with the inner cage and the hook is placed adjacent a wire of the cage and turned with force until beneath the wire, the hook will be snapped onto the wire engaged by it, the resilience of the spring-steel spacer locking the spacer in place when the force is released.

2. The spacer of claim 1 in which the locking means at the second end of the spacer includes a downwardly and inwardly extending hook that also extends away from the plane of the loop and in a direction away from the plane of the locking hook at the first end of the spacer, the said hook of the locking means being engageable with either a vertical or horizontal wire of the inner cage.

3. The spacer of claim 1 in which the locking means at the second end of the spacer includes a second U-shaped loop formed in the straight portion of the material near the second end of the spacer, the second loop being formed to extend over one of the wires of the inner cage to position that cage relative to the outer cage, an eye extending outwardly from the second loop to form a second rounded nose that it is engageable with the inner surface of the concrete form to position the inner cage a predetermined distance away from the inner surface, and a second locking leg of the spacer extending downwardly and inwardly from the second nose to form a second locking hook at the second end of the spacer in a plane on the other side of the plane of the first loop, said second hook extending under, inwardly and then upwardly around the same one of the wires of the inner cage engageable by the second loop to positivelty lock the second end of the spacer onto a wire of the inner cage so as to position the inner cage relative to the outer cage and also relative to the inner suface of the forms.

* * * * *